US006463661B2

(12) United States Patent
Skipper

(10) Patent No.: US 6,463,661 B2
(45) Date of Patent: Oct. 15, 2002

(54) MAGNETIC SHAVING SYSTEM

(76) Inventor: Adam M. Skipper, 3826 E. Orchid Land, Phoenix, AZ (US) 85044

( * ) Notice: Subject to any disclaimer, the term of this patent is extended or adjusted under 35 U.S.C. 154(b) by 0 days.

(21) Appl. No.: 09/864,016

(22) Filed: May 23, 2001

(65) Prior Publication Data

US 2001/0022025 A1 Sep. 20, 2001

Related U.S. Application Data

(62) Division of application No. 09/388,019, filed on Sep. 1, 1999, now Pat. No. 6,327,779.

(51) Int. Cl.[7] ..... B26B 21/40; B26B 19/38; B26B 19/40

(52) U.S. Cl. ..... 30/74; 30/34.05

(58) Field of Search ..... 30/32, 34.05, 34.2, 30/35, 36, 43, 43.91, 41.6, 41; 132/290

(56) References Cited

U.S. PATENT DOCUMENTS 1,299,098 A * 4/1919 Ames ..... 30/74
1,914,925 A * 6/1933 Nones ..... 30/74
2,200,186 A * 5/1940 Muros ..... 30/43
2,370,815 A * 3/1945 Ross ..... 30/74
2,532,372 A * 12/1950 Sanders ..... 30/74
2,705,834 A * 4/1955 Lundy ..... 30/74
3,031,757 A * 5/1962 Kramer ..... 30/74
3,235,962 A * 2/1966 Greenly ..... 30/74
3,660,894 A * 5/1972 Sand ..... 30/74
3,695,934 A * 10/1972 Fledhaus
3,815,603 A * 6/1974 Sramek
3,918,154 A * 11/1975 Pagani ..... 30/34.2
3,949,469 A * 4/1976 Brauss ..... 30/43.91
4,046,591 A * 9/1977 Laguerre
4,498,474 A * 2/1985 Chalmers et al.
4,628,037 A * 12/1986 Chagnon et al.
5,476,650 A * 12/1995 Patel
5,522,814 A * 6/1996 Bernaz
5,587,156 A * 12/1996 Wdowik
5,638,042 A * 6/1997 McCoy ..... 30/74
5,683,380 A * 11/1997 Eckhouse et al.
5,816,726 A * 10/1998 DeBourg et al.
5,827,294 A * 10/1998 Mehl, Sr.
5,846,252 A * 12/1998 Nehl, Sr.
6,327,779 B1 * 12/2001 Skipper ..... 30/74
6,332,469 B2 * 12/2001 Treskov et al. ..... 132/290

FOREIGN PATENT DOCUMENTS

EP 0 364 637 A1 4/1990

* cited by examiner

*Primary Examiner*—Hwei S. Payer
(74) *Attorney, Agent, or Firm*—Snell & Wilmer L.L.P.

(57) ABSTRACT

A magnetic shaving system includes a pre-trimming solution containing particles having magnetic properties and a shaving apparatus having a magnet. The shaving apparatus may include only a magnet or may include a magnet in proximity of a typical razor blade. The pre-trimming solution is applied to the desired area and the magnetic shaving apparatus is applied over the solution. The magnetic solution surround the hairs and causes the hairs to be drawn toward the magnetic shaving apparatus and away from the skin, yielding a more comfortable and effective shave.

4 Claims, 5 Drawing Sheets

MAGNETIC SHAVING SYSTEM

REFERENCE TO RELATED DOCUMENTS

This application is a divisional of, and claims priority to, U.S. Ser. No. 09/388,019, filed on Sep. 1, 1999 now U.S. Pat. No. 6,327,779.

BACKGROUND OF THE INVENTION

1. Field of the Invention

The present invention relates generally to a hair removing system. More particularly, the present invention relates to the use of magnetic dust to lift the hair strands away from the skin and the use of magnets for shaving the unwanted hair.

2. Background Information

Hair trimming and/or hair removing is typically a part of every day life for many people. Whether for cosmetic reasons (e.g., shaving of face, legs, and underarms) or for functional reasons (e.g., shaving the scalp for ventilation, shaving to prepare a patient for surgery), the need for comfortable, effective, and inexpensive hair removal exists. However, many obstacles prevent people from obtaining effective hair management. Particularly, due to the hair strands lying against, or in close proximity to, the skin, current shaving techniques typically require the shaving device to scrape a sharp metallic razor against the skin surface to allow the razor to contact and cut the hair strand. Many individuals who use razors have sensitive skin that often cannot withstand the rigors of traditional hair trimming and/or removing systems, especially when the risks associated with some hair trimming and/or removing techniques, such as cuts, nicks, and abrasions, aggravate the skin condition. Further, many people require daily hair maintenance or removal which is a substantial hurdle for people who do not have the time to perform the required hair removal or for individuals whose skin is too sensitive to withstand the excessive irritation of daily hair removal. Other disadvantages of several types of prior art hair removal methods often include the inherent pain of the removal process and the exorbitant cost of many of these procedures. Moreover, after subjecting the skin to these harsh conditions, many people discover that the prior art razors did not actually cut the hair strand at a sufficiently low point, thereby leaving the skin surface unacceptably rough or allowing the hair to grow back to be visible on the skin surface within hours.

Many prior art shaving products attempt to trim or remove hair using different techniques. As discussed, the most common removal technique includes a razor, which requires scraping a sharpened blade across the skin's surface. Standard non-electric razors often employ one or more straight razor blades stacked on top of one another but slightly offset to allow consecutive cutting of the same hair strand. The blades are scraped directly over the skin to enable the blade to slice the individual hair shaft; however, the cutting of the shaft is typically limited to a point at or above skin level. While the use of shaving creams can reduce the irritation associated with contacting the skin with the blade(s), standard razor shaving often continues to provide sufficient irritation of the skin because of the contact between the sharp steel blade and the delicate skin. This method of hair removal, while inexpensive, is thus often undesirable because of the harsh environment the skin must withstand to effectuate hair trimming and/or removing. Yet, because the hair is typically cut above skin level, it is also undesirable because it requires nearly daily upkeep to minimize hair growth.

Electric razors typically employ a similar theory of hair trimming. Electric razors often have multiple rotating heads, wherein each head contains several sharpened areas which act as blades. The blades in an electric razor also are typically limited to slicing hair at or above skin level. Electric razors suffer many of the same drawbacks of non-electric razors in that they may irritate the skin; however, they are less effective than non-electric razors because they are not able to trim hair as close to the skin. Therefore, the less effective hair trimming and/or removing coupled with the need for daily maintenance also make this method less desirable.

Another type of hair management system is waxing. Waxing commonly employs placing a layer of hot wax directly on the skin, allowing the wax to cool, then subsequently ripping the wax from the skin thereby causing the hair and the hair follicle to be torn out of the skin. Although waxing often removes the entire hair strand, this procedure is usually extremely painful and should ideally be performed by a trained professional, thereby increasing the cost. The time period for hair regrowth after waxing is somewhat longer than for traditional shaving; however, the pain and cost associated with the process often make it an undesirable hair removal option.

Two further types of hair removal systems include lasers and electrolysis. Lasers remove hair by burning the root of the hair, thereby killing the hair strand, hair follicle and related growth anatomy. Electrolysis uses electricity to shock the root of the strand, causing the strand to fall out. While laser and electrolysis have the advantage of being potentially long-term to permanent solutions, they both suffer from serious drawbacks. Electrolysis is extremely painful, and the long-term effectiveness of lasers has yet to be conclusively proved. Further, both types of removal are typically expensive, and therefore, these options are impractical for most consumers.

Therefore, a need exists for an improved hair removal system that overcomes the obstacles encountered in the prior art.

BRIEF SUMMARY OF THE INVENTION

The present invention relates to an improved method of hair trimming and/or removing. More particularly, the present invention relates to a method of hair trimming and/or removing that employs a magnet to effectuate the trimming and/or removing. Particles having magnetic properties and which surround the hair are added to a pre-trimming solution. A magnet is affixed in close proximity to a razor surface such that the magnet of the shaving apparatus attracts the magnetic particles that were added to the pre-trimming solution, causing the hair shaft to lift up and away from the skin, thereby allowing the razor to trim the hair at a lower point on the shaft. Alternatively, a stronger magnetic pad may be used without a razor such that the pad suitably pulls the hair out of the skin. An optional post-removal solution may be applied to the skin to minimize discomfort. Alternatively, a deionizer is suitably applied to the magnetic shaving apparatus or the magnet is removed from the apparatus to remove the magnetic dust which may have collected on the shaving apparatus.

BRIEF DESCRIPTION OF THE DRAWINGS

A more complete understanding of the present invention may be derived by referring to the detailed description and claims when considered in connection with the following illustrative Figures, which may not be to scale. In the following Figures, like reference numbers refer to similar elements throughout the Figures.

DETAILED DESCRIPTION OF THE PREFERRED EMBODIMENTS

The present invention includes a method and apparatus for using magnetic properties to assist in trimming and/or removing hair. Generally, the present invention includes small magnetic particles which suitably surround or attach to hair strands, such that, when an attracting magnetic force is applied to the magnetic particles, the hair strands are lifted up away from the skin, thereby allowing the hair strands to be pulled from the skin or to be cut at a point low on the shaft. As such, one skilled in the art will appreciate that any discussion of hair trimming also applies to removal of the hair strand. The hair may be located anywhere on a human body or anywhere on any other mammal, creature or other organism. The apparatus and method may also apply to the removal or trimming of strands of material from textile products, furs, seat covers or any other product which may include strands of material.

Figure 1:
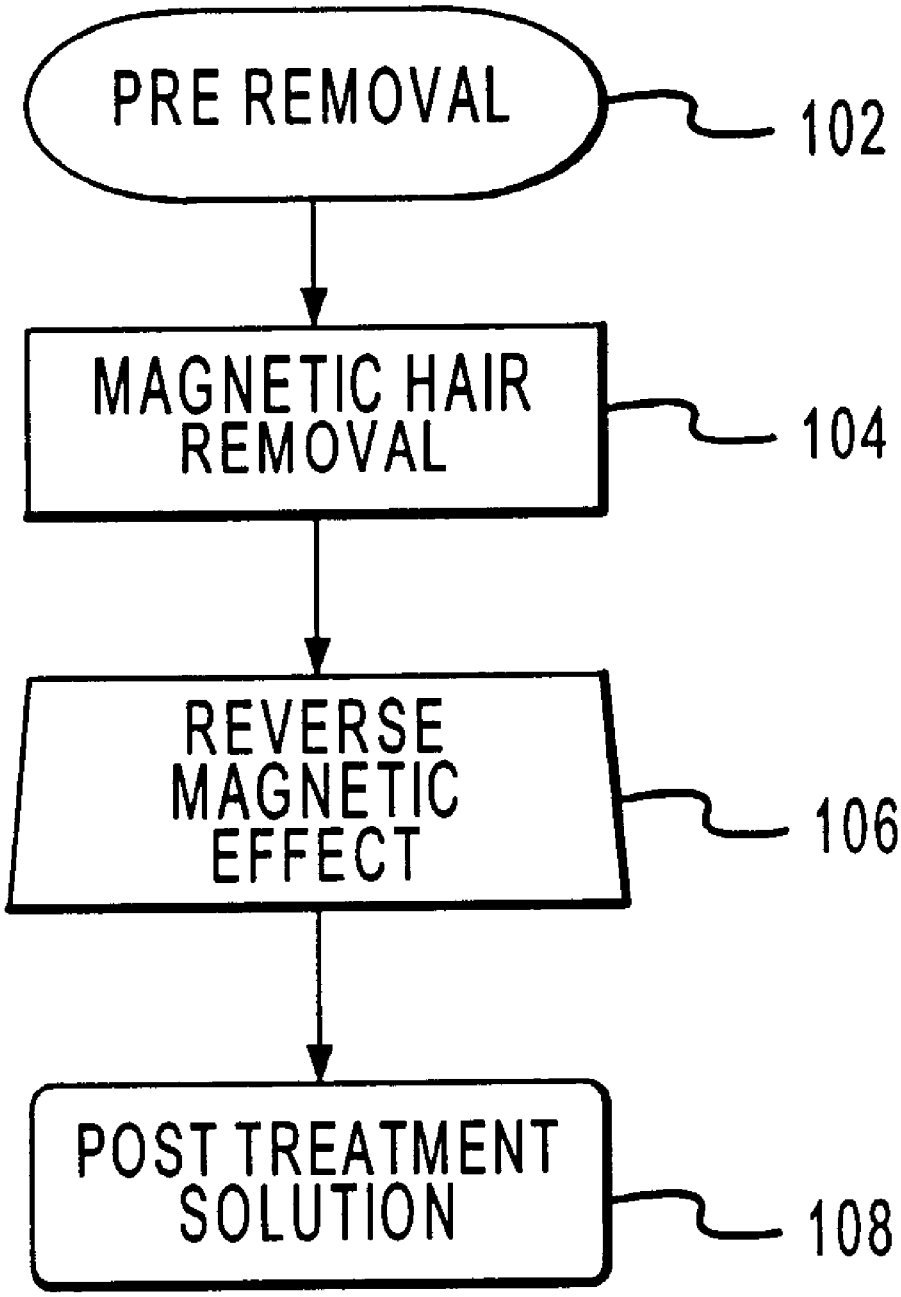
FIG. 1 is an exemplary flow chart of the process for utilizing the apparatus of in accordance with a preferred embodiment of the present invention.

With respect to FIG. 1, a flowchart of an exemplary method for a magnetic hair trimming and/or removing process is shown. A pre-trimming solution is preferably applied to the desired area (Step 102). The pre-trimming solution can be any shaving solution known in the art such as shaving creams, gels, foams, lotions and/or the like, but the solution preferably contains emollients, skin pore openers, and may optionally contain any other type of known skin treatment composition. The pre-trimming solution may also optionally condition the skin and open the skin's pores. In a preferred embodiment, the pre-trimming solution contains microscopic metal-oxide particles which adhere to, or surround, the hair strand, thereby forcing the strand to be attracted to the magnetic shaving apparatus. Tests revealed that a natural source of ferric-ferrous oxide ($Fe_3O_4$) is the preferred magnetic material to incorporate into commercially available shaving cremes. The actual magnetic material used was extracted from a sand substance containing 30% magnetite and 70% quartz, feldspar, pyroxene and amphibole. The sand was further purified by using a magnet to perform a course magnetic separation technique to yield the final material which was greater than 95% magnetite. In an alternative embodiment, to minimize the need for purification and resizing, synthetic metal-oxides, such as magnetite or maghemite, may be used because synthetic metal-oxides are typically available in many particle sizes.

The purified magnetic material is then ground in a ceramic mortar. and pestle to reduce the sand-sized grains to dust-sized level sufficient for mixing with shaving creme and applying to the skin surface. One skilled in the art will appreciate that any known method for reducing the magnetite particle size can be used when preparing the current shaving creme mixture. Moreover, the microscopic metal-oxide particles are suitably added to the pre-trimming solution in any way known in the art, for example, by thoroughly mixing finely ground particles with the pre-trimming solution. Depending on the desire of the individual, one skilled in the art will appreciate that shaving cremes of different viscosities may be incorporated in the present invention.

The magnetic shaving apparatus is next applied to the skin (Step 104).

Due to the metallic particles adhering to or surrounding the hair shaft, the magnetic attraction resulting from the application of the magnetic hair removing apparatus causes the hair to be pulled gently out of the skin with minimal contact by the apparatus. Additionally, because the removing would be below the skin's surface, instead of the superficial hair removing of traditional shaving, hair removing may be conducted less frequently. Reducing the abrasive contact and reducing the frequency of shaving will minimize discomfort for individuals with sensitive skin and other skin disorders. Further, magnets and magnetite particles are inexpensive; therefore, the present system is relatively low-cost, and thus, desirable to the ordinary consumer.

Figure 2:
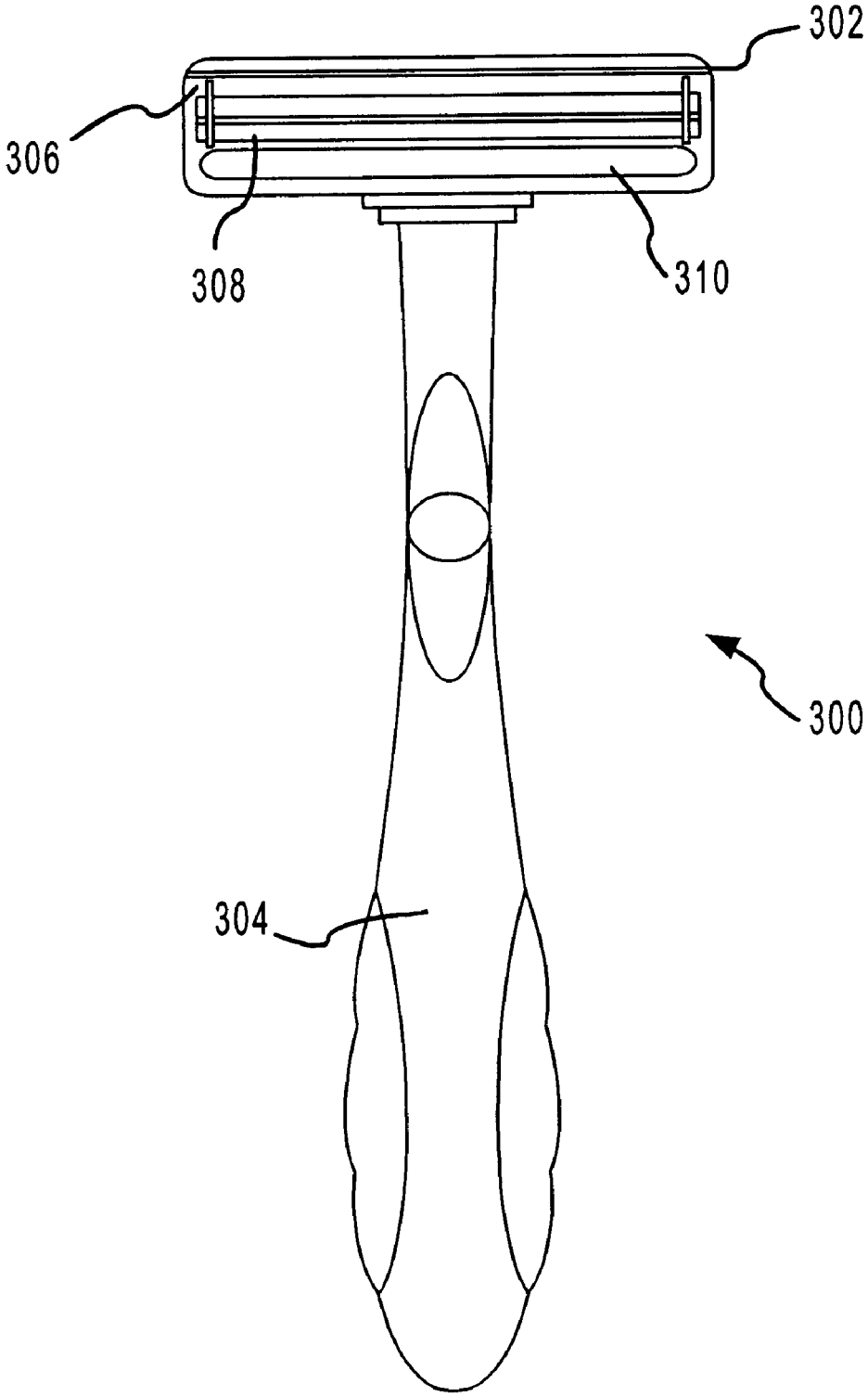
FIG. 2 is an exemplary front view of a razor in accordance with a preferred embodiment of the present invention.
Figure 3:
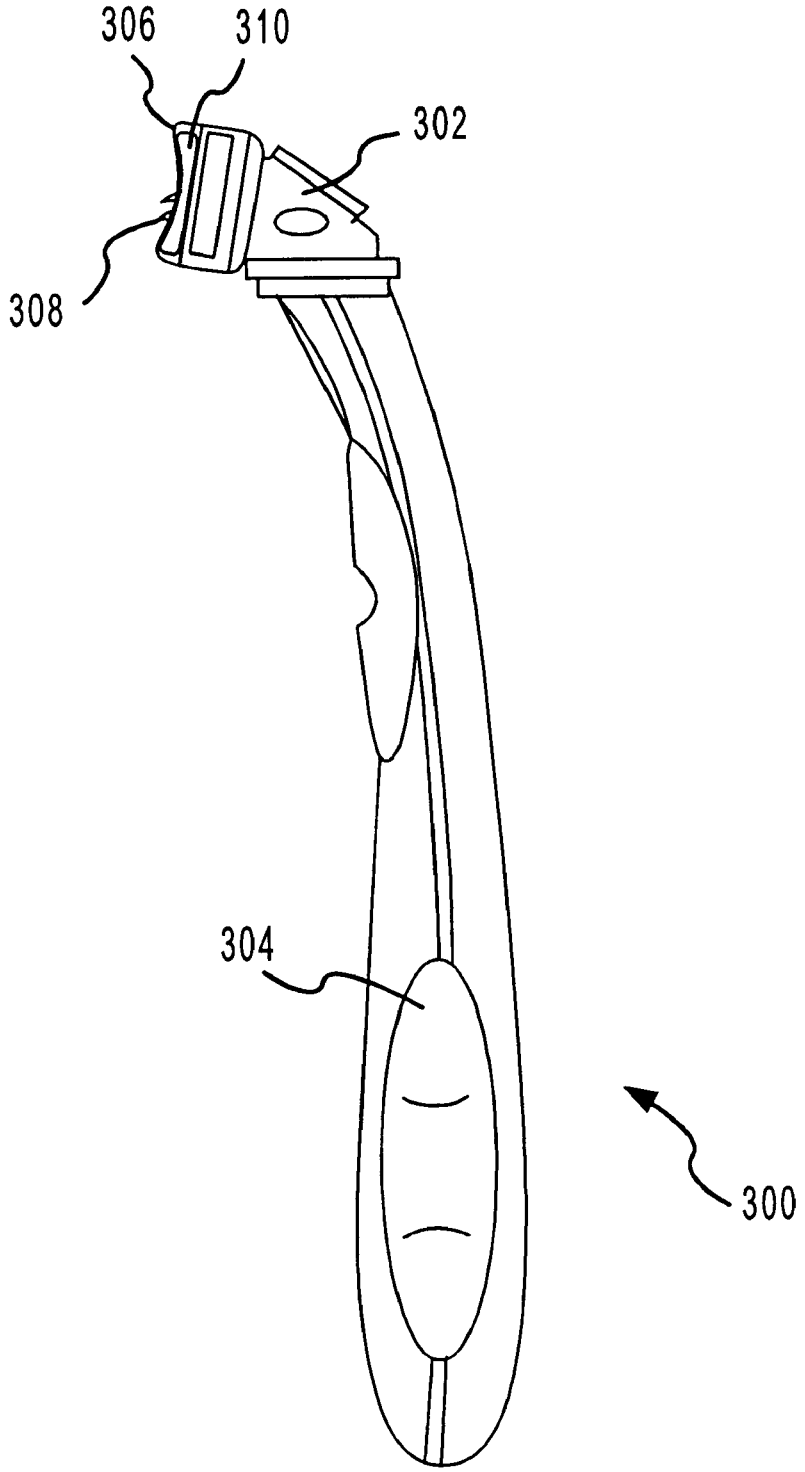
FIG. 3 is an exemplary side cut-away view of the razor of FIG. 2 in accordance with a preferred embodiment of the present invention.
Figure 4:
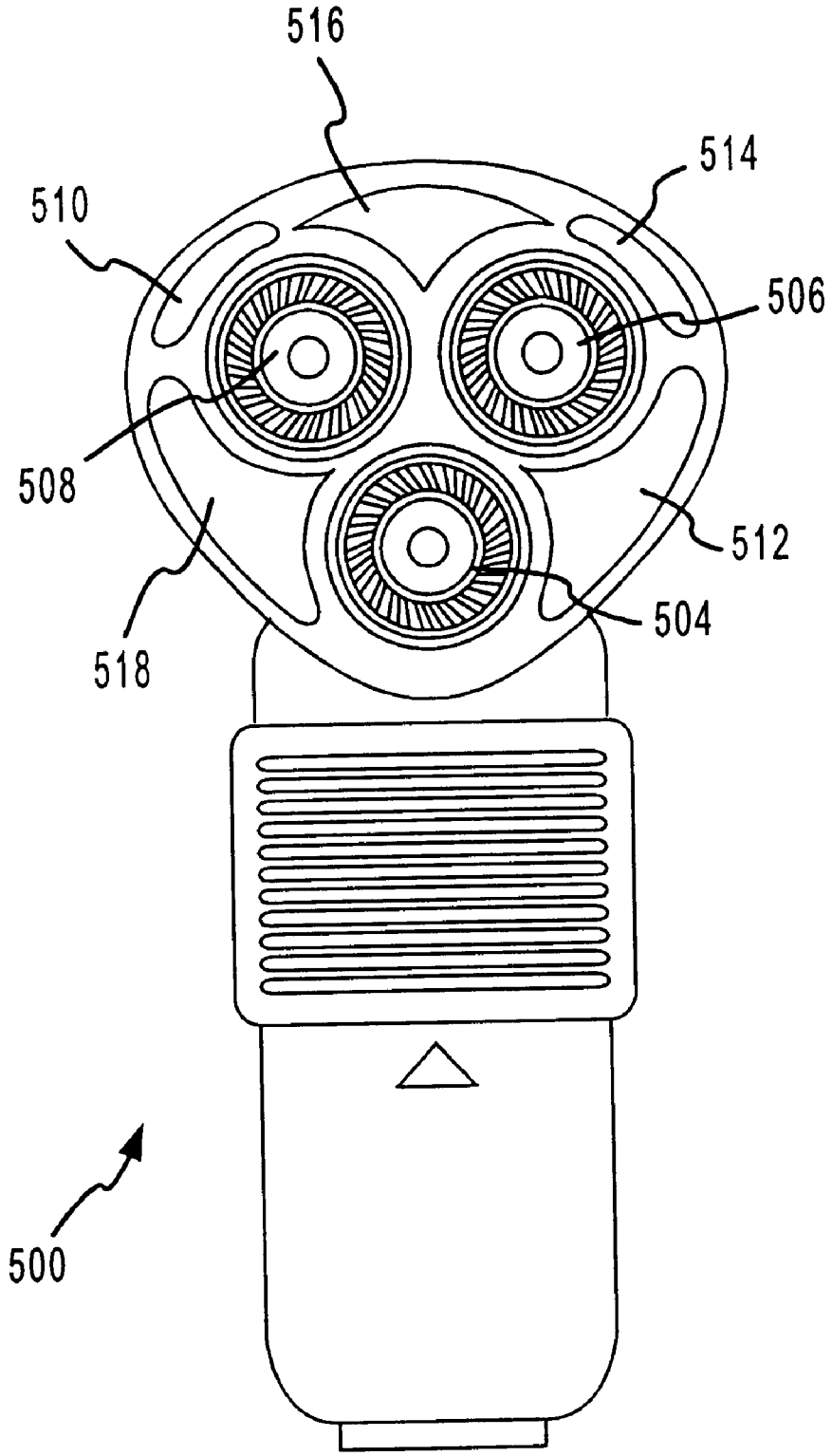
FIG. 4 is an exemplary electric razor in accordance with a preferred embodiment of the present invention; and, FIG. 5 is an exemplary side cut-away view of the razor of FIG. 2 in operation in accordance with a preferred embodiment of the present invention.

With respect to FIGS. 3 and 4, preferred exemplary magnetic shaving apparatus are shown. Razor 300 includes a housing 302 comprised of shaft 304 and head 306. Housing 302 may be an integral one-piece unit or may be constructed from numerous pieces. Housing 302 is preferably constructed of a hard, sturdy material, such as, for example, a plastic, metal and/or the like. While the general shape of shaft 304 as shown in FIG. 2 is preferable, shaft 304 may have any shape that enables the user to effectively apply the shaving apparatus to the desired area. Razor 300 further comprises a blade 308, or a combination of blades, which may be any known razor blade(s). Blade 308 is placed in housing 302 such that the sharpened edge can suitably contact the user's skin.

Figure 5:
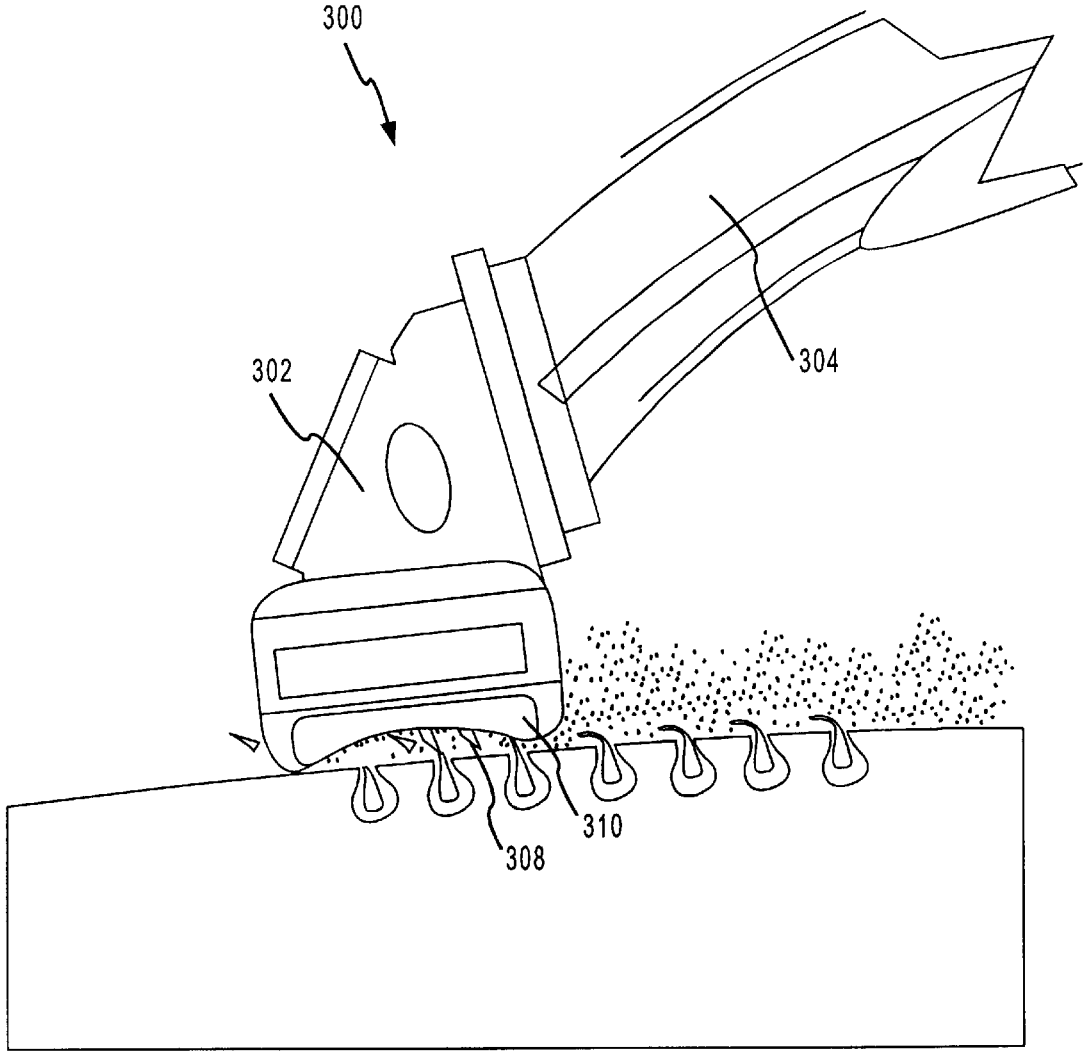

Magnet 310 is disposed in housing 302 such that it is in proximity with blade 308, thereby enabling magnet 310 to attract the hair strands that have been treated with pre-trimming solution and force the strands toward the magnet 310. With respect to FIG. 5, the magnet 310 is preferably placed behind or below the blade to allow the magnetic forces to be applied to the solution and the hair before the razor scrapes over the hair. After the strands are lifted up and away from the skin, blade 308 slices the strand. Magnet 310 may be attached directly to housing 302 by any known method, such as adhesives, Velcro™, snaps, grooves and/or the like, or may be made integral with housing 302. Magnet 310 may be a single magnet as shown in FIG. 2, or may be comprised of smaller magnets that are disposed in proximity to blade 308. It is understood that the configuration of magnet 310 is not limited to the illustrative embodiment shown in FIG. 2 because the magnet 310 can be connected to the blade to magnetize the blades, magnet 310 can surround the blade, magnet 310 can be above the blade, magnet 310 can be between two blades or between any number of blades and/or the like. One skilled in the art will also appreciate that magnet 310 can be a magnetic material or a magnetic field established by sending an electric current through any suitable conductive material. Moreover, as best-shown in FIG. 5, magnet 310 is preferably concave to provide space between the shaving surface and the magnet surface. This space allows the collection of the magnetic particles, while minimizing the interference of the magnetic particles with the blade/skin interface. Furthermore, any suitable Tesla magnetic strength is within the scope of the present invention because the appropriate Tesla strength magnet will depend on the user's tolerance of magnetic forces.

The magnetic shaving apparatus may also be an electric razor, an example of which is shown in FIG. 4. Razor 500 preferably includes a housing which contains rotating blade heads. In this embodiment, three rotating blade heads 504, 506, and 508 are shown. It is understood, however, that any number of rotating blade heads in any configuration may be implemented; the number in configuration shown in FIG. 4 are merely for illustrative purposes. A single magnet or multiple magnets may be placed at any location around the rotating blade heads; for example, magnets may be placed in any or all of locations 510, 512, 514, 516, or 518. The magnets 510, 512, 514, 516, and 518 would then act to attract the hair strands that have been treated with pre-trimming solution and force the strands toward the magnets. Rotating blade heads 504, 506, and 508 would subsequently cut the hair strands which are lifted up away from the skin. The magnets may be attached directly to the housing 502 by any known method, such as adhesives, Velcro™, snaps, grooves and/or the like, or may be made integral with the housing 502. It is understood that the configuration of the magnets is not limited to the illustrative embodiment shown in FIG. 4. For example, a single magnet of any size may be coupled with the housing, including a configuration having a single magnet that at least substantially encircles the perimeter of the electric razor.

Referring back to FIG. 1, after or during shaving with the magnetic shaving apparatus, another magnet is suitably applied to the magnetic shaving apparatus (Step 106). The second magnet may be any magnet or other element or material that alters the magnetic attraction between the magnet of the shaving apparatus and the particles collected upon it. Thus, the placement of the second magnet on the magnetic shaving apparatus would create a repelling magnetic effect which would repel the removed hair into a sink, the trash, or any other receptacle. Alternatively, magnet 310 may be removed from the apparatus to remove the magnetic force or demagnetize the blade, so that the magnetic particles will fall off of the blade. While this is not essential to the shaving process itself, this step permits the magnet to be cleared of hair and magnetic particles to preserve the magnetic strength and to allow the magnet to be used repeatedly. The magnet removal may be applied to any embodiment of the magnetic shaving apparatus, including those shown in FIGS. 2–5.

Optionally, the user can use a post-trimming solution to tighten pores and condition skin after hair trimming (Step 108). This optional solution may contain any known ingredients that may effectuate these goals, but the post-trimming solution preferably contains emollients, lotions and oils.

The present invention has been described above with reference to a preferred embodiment. However, those skilled in the art having read this disclosure will recognize that changes and modifications may be made to the preferred embodiment without departing from the scope of the present invention. For example, various steps of the invention, such as the post-trimming solution, may be skipped without altering the effectiveness of the invention. Additionally, use of different known magnetic materials such as maghemite, gamma-$Fe_2O_3$ or known pre/post-trimming solution additives are within the scope of the invention. These and other changes or modifications are intended to be included within the scope of the present invention, as expressed in the following claims.

What is claimed is:

1. A method of exerting a magnetic force on a shaving surface during a shaving operation comprising the steps of:

providing a magnetic shaving apparatus having a housing, a razor blade coupled to said housing, and a first magnet coupled to said housing in proximity of said razor blade;

applying pre-shaving solution containing magnetic particles to the shaving surface so that hairs on the shaving surface are covered with the magnetic particles; and moving the magnetic shaving apparatus across the shaving surface such that said first magnet applies the magnetic force on the magnetic particles covered hairs in order to lift the hairs up from the shaving surface to facilitate the shaving operation.

2. The method of claim 1 wherein said providing step comprises said housing being an electric shaving apparatus housing.

3. The method of claim 1, wherein said first magnet is at least one of: attached to said razor blade, between a plurality of razor blades, above said razor blade, below said razor blade, surrounding said razor blade and generated within said razor blade by passinga current through said razor blade.

4. The method of claim 1, further comprises providing at least one of: a repelling magnet and a removable magnet configured to be intermittently placed adjacent to said first magnet to detach collected debris from said first magnet.

* * * * *